US006802137B1

(12) United States Patent
Gray

(10) Patent No.: US 6,802,137 B1
(45) Date of Patent: Oct. 12, 2004

(54) SOLVENT DRYING METHOD

(76) Inventor: Donald Gray, 9 McGraw Ct., Warwick, RI (US) 02818

( * ) Notice: Subject to any disclaimer, the term of this patent is extended or adjusted under 35 U.S.C. 154(b) by 0 days.

(21) Appl. No.: 10/721,134

(22) Filed: Nov. 25, 2003

(51) Int. Cl.[7] ..... F26B 3/00

(52) U.S. Cl. ..... 34/340; 34/348; 34/404; 34/417

(58) Field of Search ..... 34/330, 337, 340, 34/343, 348, 402, 404, 417, 92

(56) References Cited

U.S. PATENT DOCUMENTS 4,016,657 A * 4/1977 Passey ..... 34/92
5,956,859 A * 9/1999 Matsumoto et al. ..... 34/74
6,256,903 B1 * 7/2001 Rudd ..... 34/412
6,263,587 B1 * 7/2001 Raaijmakers et al. ..... 34/404
6,289,605 B1 * 9/2001 Chang ..... 34/471
6,745,494 B2 * 6/2004 Bergman et al. ..... 34/410

FOREIGN PATENT DOCUMENTS

JP 11116218 * 4/1999 ..... C01B/31/02
JP 11329977 * 11/1999 ..... C23C/14/00

* cited by examiner

*Primary Examiner*—Stephen Gravini
(74) *Attorney, Agent, or Firm*—Barlow, Josephs & Holmes, Ltd.

(57) ABSTRACT

The present invention is directed to a controlled environment processing chamber of chambers in which parts are to be dried. The parts either contain water on or imbibed into the part. The process includes a means of applying a negative gauge pressure to the chamber to remove air or other non-condensable gases. Further, means are provided for introducing a solvent in a vapor state to the chamber to cause the water to flash off the part. A first system recovers water or aqueous solution(s) from the object being dried and the chamber. A second system, separate from the first system, further recovers residual solvent from the object and chamber after the drying process.

11 Claims, 6 Drawing Sheets

10

CARBON
66
38
72
28
22
18
20
PROCESSING CHAMBER
14
12
34
32
36
44
CHILLER
58
52
50
SEPARATION TANK
40
WASTE WATER
60
56
30
62
50
54
42
ELECTRICAL POWER
16
48
24
CLEAN FLUID HOLDING TANK
26
FLUID SUPPLY TANK
68

PCE-WATER PHASE DIAGRAM

TCE-WATER PHASE DIAGRAM

10

CARBON
66
38
72
28
22
18
20
PROCESSING CHAMBER
14
12
34
32
36
44
CHILLER
58
52
SEPARATION TANK
40
WASTE WATER
60
56
30
62
64
50
54
42
ELECTRICAL POWER
16
48
24
CLEAN FLUID HOLDING TANK
26
FLUID SUPPLY TANK
68

PCE-WATER T-XY DIAGRAM

SOLVENT DRYING METHOD

BACKGROUND OF THE INVENTION

The instant invention is generally directed to a controlled environment processing chamber or chambers in which parts are to be dried. More specifically, the present invention is directed to a controlled processing method for the drying of parts during the final finishing step.

Typically, the final step in the finishing of metals, plastics, ceramics, composites and other materials often is a drying process. This step in the process is a step that is often overlooked from the cost and efficiency perspective. However, the cost associated with poorly dried parts can be seen in that it leads to future problems such as corrosion, poor adhesion, and peeling and at minimum an unattractive cosmetically prepared piece. In addition, the drying step may become a significant cost factor especially if energy prices are high.

Therefore it is a desire of the present invention to provide a faster, more efficient, lower cost parts drying method. For the purposes of the present invention the method described herein will be discussed in comparison to traditional forced convection air-drying in order to emphasize the difference in the method of the present invention from traditional techniques, as well as to compare the important improvements and cost savings associated with the present method.

BRIEF SUMMARY OF THE INVENTION

In this regard, as stated above, the present invention is directed to a controlled environment processing chamber or chambers in which parts are to be dried. The parts either contain water on or imbibed into the part. The process includes a means of applying a negative gauge pressure to the chamber to remove air or other non-condensable gases. Means are provided for introducing a solvent in a vapor state. A first system recovers water or aqueous solution(s) from the object being dried and the chamber. A second system, separate from the first system, further recovers residual solvent from the object and chamber after the drying process.

In another aspect of the invention, a method of processing an object in an enclosed solvent processing system is provided. The process includes a solvent or steam supply system in sealable communication with an enclosed chamber and includes the steps of:

a) sealing the solvent or solution supply system with respect to the chamber;

b) evacuating the supply system of air and non condensable gases and maintaining this air free environment;

c) opening the drying chamber to atmosphere and placing an object to be dried in the chamber;

d) evacuating the drying chamber to remove air and other non-condensable gases;

e) opening the drying chamber with respect to the solvent supply system and introducing a solvent or solution into the evacuated chamber;

f) opening the drying chamber with respect to a closed circuit vapor recovery system;

g) continuously introducing and removing vapor from the chamber to continuously remove water from the part and chamber;

h) continuously removing water and drying the object while maintaining an air free environment within the chamber;

i) recovering and processing the solvent and water removed from the chamber within the closed circuit processing system;

j) sealing the chamber with respect to the atmosphere;

k) opening the chamber with respect to a closed circuit vapor recovery system recovering and recycling the solvent introduced into the chamber within the closed circuit processing system;

l) sealing the chamber with respect to the solvent supply system closed circuit solvent processing system;

m) introducing air or other non condensable gases into the chamber for sweeping further solvent on the object and within the chamber; and n) opening the chamber and removing the treated object.

The main objective of this invention is to remove water or an aqueous solution from an object in a manner that is faster and better from an economic and efficiency standpoint than air or vacuum drying. In order to accomplish this, a solvent, which is insoluble or sparingly soluble in water, is used to remove water as vapor from a part and drying chamber. Another main objective of this invention is to dry water or an aqueous solution from a part rapidly so as to save energy. Another main objective of this invention is to dry water rapidly so as to disrupt the surface or pores of a part thereby removing foreign material from the part. Another main objective of this invention is to dry water rapidly so as to prevent water spotting on the part. Another main objective of this invention is to combine the water drying of a part into a one step process with cleaning of the part with a solvent.

Another object of this invention is to provide an improved closed circuit solvent system and method, which enables solvent recovery and limits hazardous emissions. The invention can employ a variety of solvents having boiling points as low as 70 degrees Fahrenheit and as high as 500 degrees Fahrenheit. Another object of this invention is to provide a means of recovering solvents using water or other hydrophilic solvent to provide the same benefits as outlined for water drying above.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
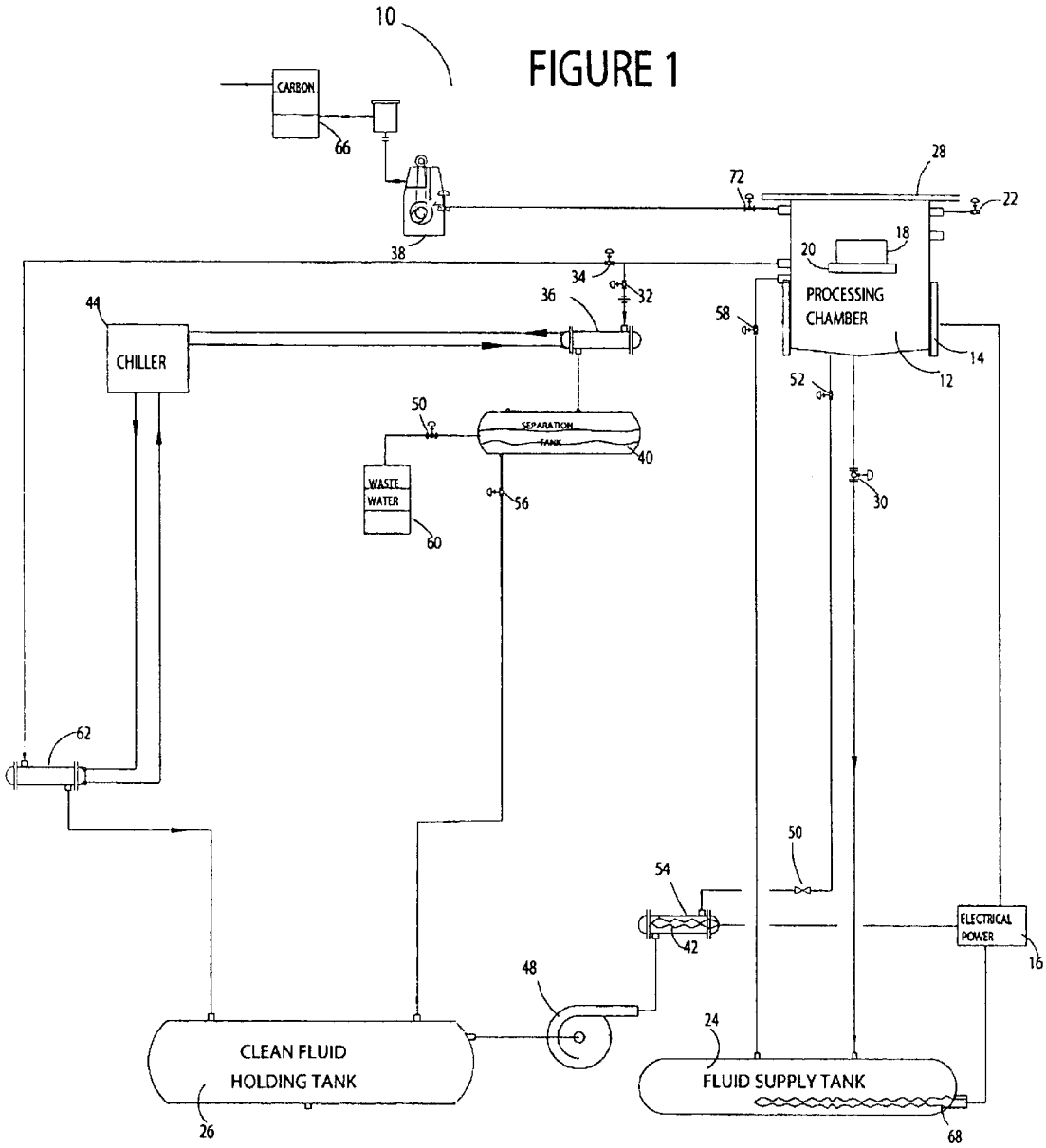
FIG. 1 is a schematic diagram of the system of the present invention.

Referring now to the drawings, the present invention in its simplest form requires a processing chamber, vapor source and a solvent recovery system. Turning first to FIG. 1 the basic equipment required to perform a reduced environment water removal cycle is depicted. This first example is a drying method utilizing a water insoluble solvent having a boiling point higher than the boiling point of water. An example of this process method would be the removal of water from the surface of an object by the introduction of tetrachloroethylene (also known as perchloroethylene or PCE) vapors to flash the water from the parts, remove the water from the chamber walls and condense the water after removal. FIG. 1 is a depiction of this process.

In FIG. 1, the process method 10 includes a drying chamber 12 having a jacket 14 in fluid communication with a fluid supply source 24. An object 18 requiring drying is either already on or is placed upon a support 20 fixedly mounted within the drying chamber 12. A valve 22, in fluid communication with the atmosphere and the cleaning chamber 12, is provided for selectively introducing air into the drying chamber 12.

The object 18 to be dried is placed into the drying chamber 12 on the support 20 through an opening created by removing a lid 28. After receiving the object 18, the lid 28 is secured to the cleaning chamber 12 wherein the cleaning chamber is sealed. The air handling vacuum pump 38 is used to remove virtually all the air from the cleaning chamber 12 through valve 72.

Drying solvent is heated and vaporized with heating element 68 activated by electrical source 16 in fluid supply tank 24. The solvent maybe heated by other conventional means such as steam, heating fluids and gas fired burners. The drying solvent vapor is preferably introduced to the drying chamber 12 from the fluid supply tank 24 as a heated vapor through valve 58. As solvent vapor enters, the water on or imbibed in the part 18 will immediately begin to evaporate because of two factors. First, the solvent will begin to condense on the part 18 and heat the part 18 and the water thereon very rapidly. The water, being at or near its vapor pressure since the chamber 12 has been evacuated prior to introducing the vapor, will flash rapidly into its vapor state. Second since PCE is insoluble in water, the partial pressure of water in the drying chamber 12 will approach the vapor pressure of the water, which in this case is constantly increasing since condensing vapor transfers heat very rapidly. The equilibrium conditions resulting from the introduction of PCE and subsequent condensing and formation of liquid PCE on the part and chamber 12 wall is depicted in the phase diagram in FIG. 2 for drying occurring at one atmosphere.

For insoluble liquids, both liquids form an equilibrium with its own vapor as if the second liquid is not even present. Since both liquids exert their own vapor pressure, the amount of vapor is actually additive under these conditions. The water droplet under these conditions heats rapidly and now diffuses rapidly into the vapor state since initially there is little water vapor in the vapor mixture created. If this mixture is continuously removed, the water concentration in the vapor state can be kept low and the diffusion rate very high. The continuous addition of solvent vapor can maintain the temperature and can easily be separated from the water after condensation.

In order to prevent a high pressure in the chamber 12 during the introduction of solvent, valve 32 can be opened connecting the chamber 12 to condenser 36. Condenser 36 serves as a cold sink when cooled by a chilling source such as chiller 44. The vapor mixture of water-PCE will be drawn to the cold sink to be condensed and sent to the water separator 40. The continuous removal of vapor from the chamber 12 reduces the partial pressure of water in the chamber 12, leading to more liquid water flashing from the part. The condensed water can be removed from the separator 40 by opening valve 50 and draining the water to waste drum 60. The condensed PCE can be recovered for further use by opening valve 56 and sending the PCE to clean fluid tank 26.

Figure 2:
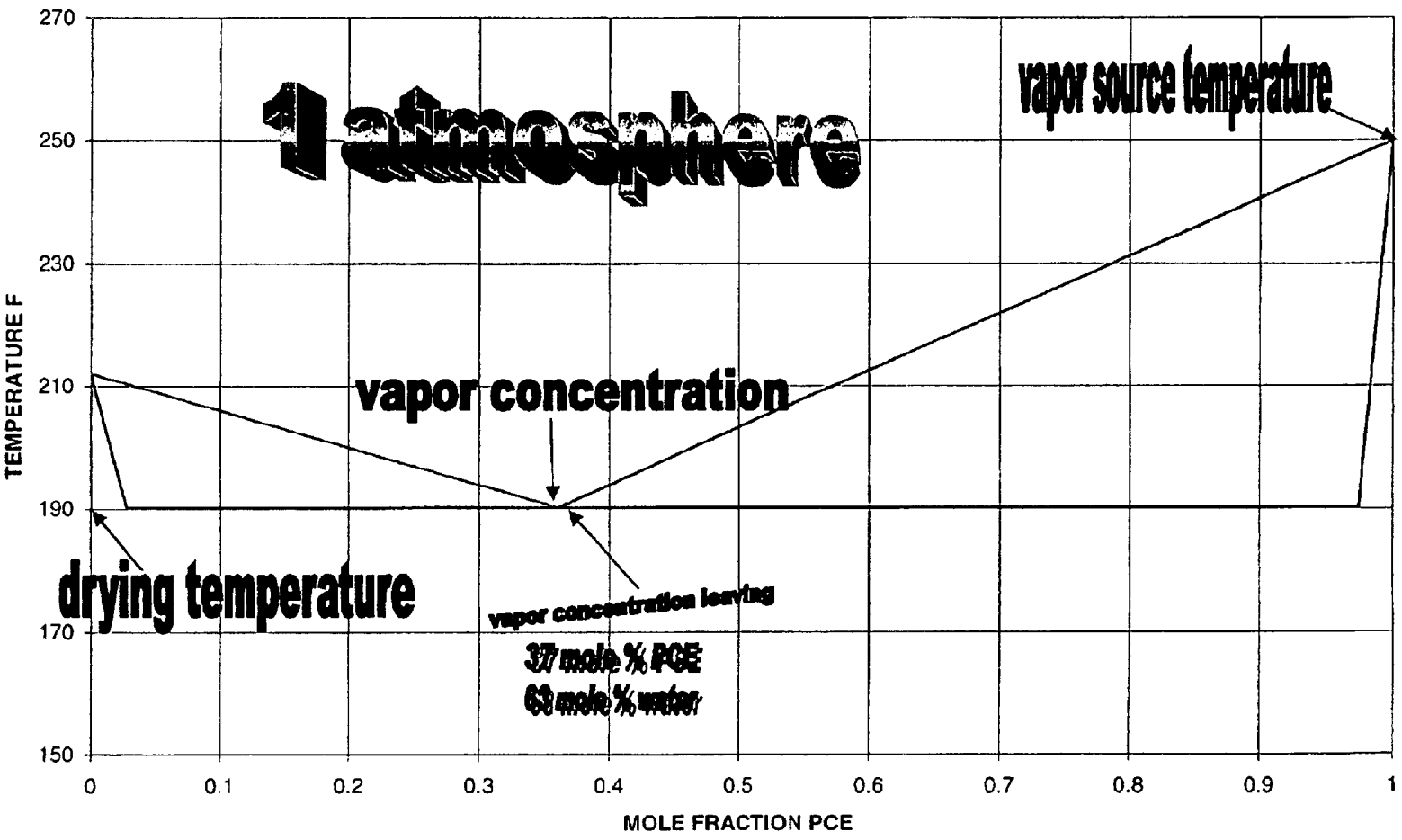
FIG. 2 is a chart detailing the relationship between the phases of water and PCE at varying temperatures at atmospheric pressure.

FIG. 2 is a chart that shows the points of interest for the process. The equilibrium conditions at 1 atmosphere show that it can expected that the entering vapor from the PCE heated solvent tank can be expected to enter the chamber at 250° F. Until there is essentially little water remaining on the part, the leaving vapor can be expected to be rich in water vapor and approach the equilibrium mixture of 63% water. The temperature of the drying is at 190° F. that would be equivalent to drying water from the part at 480 torr under a vacuum.

If one compares the drying method above to the conventional oven or vacuum drying methods, both the heat and mass transfer can be an order of magnitude higher. This translates into drying times measured in minutes rather than hours as usually encountered in industrial water drying of difficult parts.

After the object 18 has been dried, any liquid solvent remaining in the drying chamber 12 is drained and/or pumped into the heated fluid solvent vessel 24 by opening valve 30. The drained liquid will also remove most of the chips or insoluble material, if present, and transfer them also to the heated solvent vessel 24.

Solvent vapors are next removed from the cleaning chamber 12 by means of circulated recycled air through blower 48. To enhance the drying process, heater 54 can heat the air by activating heater element 42. Specifically valves 34 and 52 are opened and valve 30 is closed and blower pump 48 is activated and solvent vapors are swept from the chamber 12 and condensed in a heat exchanger 62. The clean condensed solvent and cooled air are returned to the clean fluid holding tank 26 to be stored for reuse as clean solvent for the next water drying or cleaning cycle and low humidity air for reheating and recycling for parts and chamber drying of solvent. Since PCE has a lower latent heat of vaporization than water, substituting the PCE on the part for water as described above enhances the overall drying process.

Upon removal of solvent vapor and liquid from the drying chamber 12, the chamber 12 is then returned to atmospheric pressure by introducing ambient air through valve 22 to the drying chamber 12. The drying chamber 12 may contain residual solvent vapors, which can be removed by evacuating the chamber 12 through valve 72 using the vacuum pump 38. Collecting residual solvent in activated carbon filter 66 or in scrubbers or other conventional air stripping processes can treat the effluent air stream. This introduction of air followed by purging the drying chamber 12 can be repeated as many times as necessary prior to opening the chamber 12 and removing the dried article 18.

Figure 3:
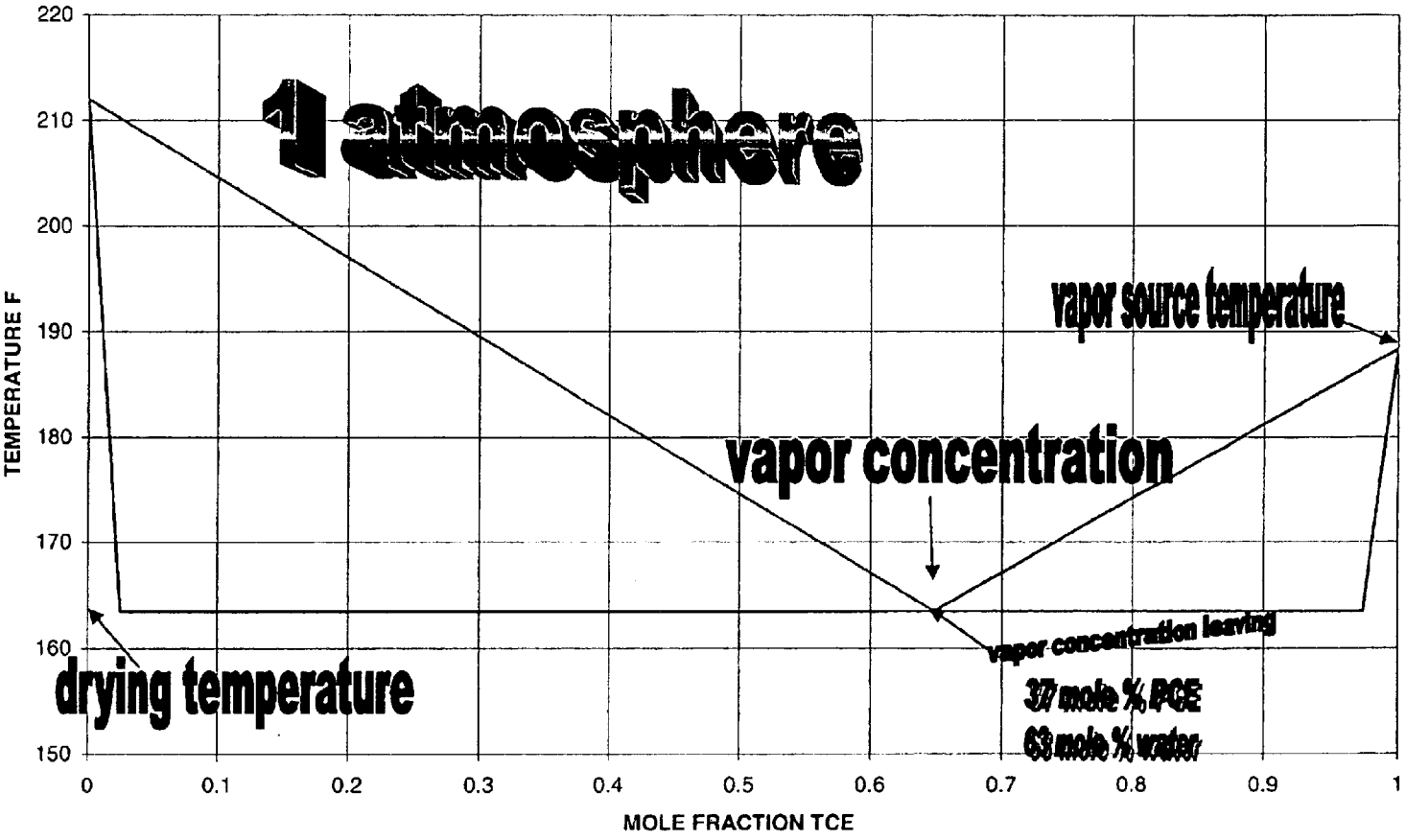
FIG. 3 is a chart detailing the relationship between the phases of water and PCE at varying temperatures at atmospheric pressure.

In the process above, the solvent used for drying has a higher normal boiling point than water. The drying method described, works just as well using a solvent having a normal boiling point below water. FIG. 3 shows a phase diagram for trichloroethylene (TCE) and water. At 1 atmosphere it can be expected that the entering vapor from the TCE heated solvent tank can be expected to enter the chamber at 189° F. Until there is essentially little water remaining on the part, the leaving vapor can be expected to be rich in water vapor and approach the equilibrium mixture of 35% water. The temperature of the drying is at 163° F. that would be equivalent to drying water from the part at 250 torr under a vacuum.

The method therefore can use any solvent which has a limited solubility with water as a drying agent. Solvents with normal boiling points between 70 and 500° F. are practical in the preferred embodiment.

In the process above, the drying process is carried out near or at atmospheric pressure. It may be desirable to carry out the drying process in a vacuum. A vacuum can render the unit safe from solvent leakage to the environment and does eliminate oxygen from the chamber that can safeguard corrosive parts or prevent fire hazards if flammable solvents are used as a drying medium. The drying process is generally enhanced in a vacuum since drying can take place at lower temperatures and solvent recovery is uniform over parts and not dependent upon diffusion into bypassing air.

Figure 4:
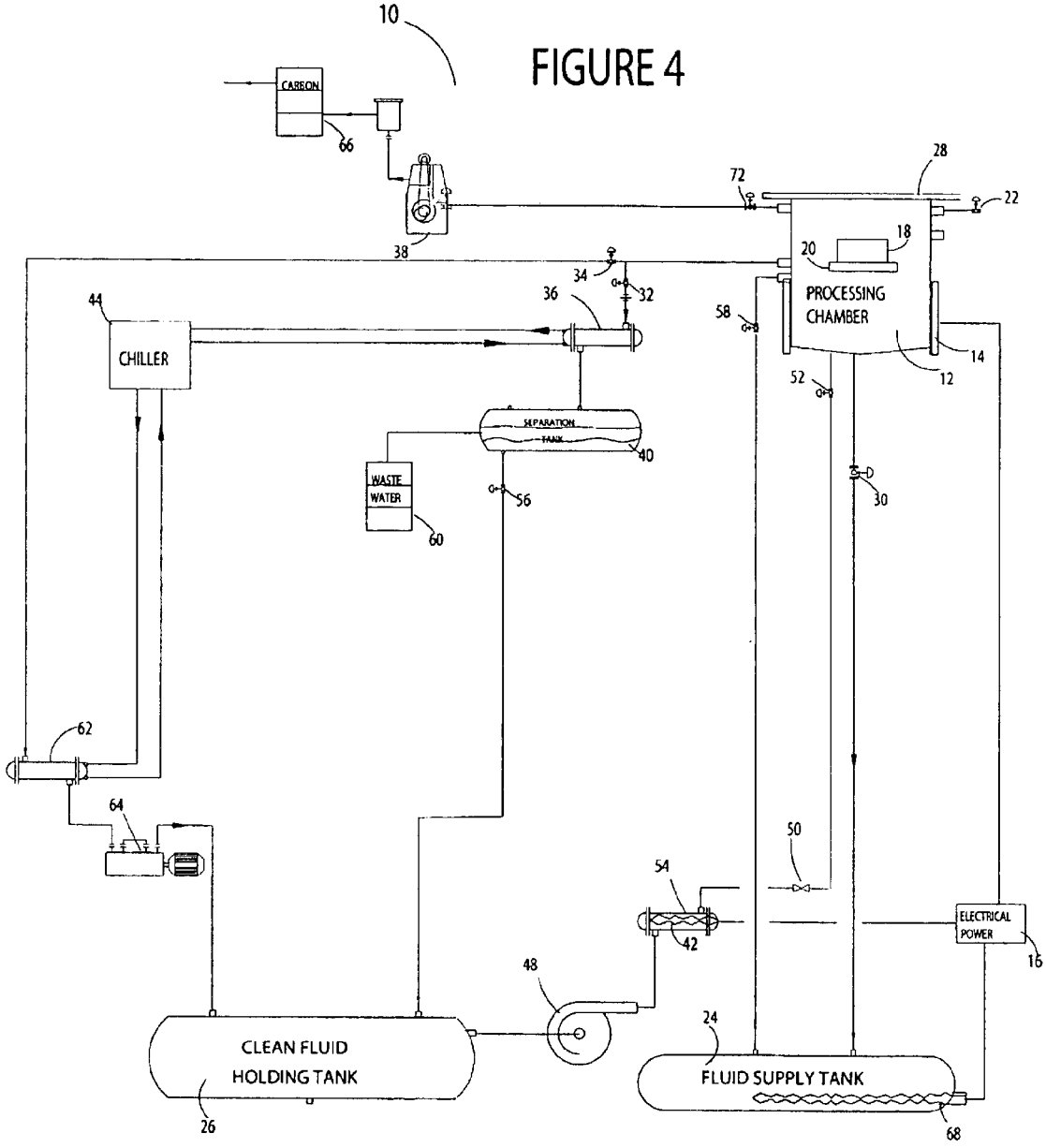
FIG. 4 is a schematic diagram of an alternative embodiment of the system of the present invention.

In a vacuum process, the steps remain the same as above however after drying water, the solvent vapors are removed from the drying chamber 12 by means of circulating air through vacuum pump 64 rather than using a blower. As depicted in FIG. 4, solvent vapors are removed from the cleaning chamber 12 by means of the solvent handling vacuum pump 64. Specifically valve 34 is opened and valve 30 is closed and vacuum pump 64 is activated and since there is no air present in this system, solvent vapors can be easily condensed in a heat exchanger 62 and the clean condensed solvent can be sent to the clean fluid holding tank 26 to be stored for reuse as clean solvent for the next drying or cleaning cycle. During this vapor-scavenging step, any residual solvent liquid remaining on the heated parts boils off the parts at the lower vacuum pressures, thus reducing solvent residual left in the vessel or on the parts. Since the solvent recovery process is a boiling process, drying is not site dependent and solvent in blind holes dry as well as solvent on the part surface. Once all the liquid has been removed from the part, continuing to pull with vacuum pump 64 further reduces the pressure in the drying chamber 12. This assures that all the liquid solvent has been dried and that the bulk of the solvent in the vapor state is also recovered.

Upon removal of solvent vapor and liquid from the drying chamber 12, the chamber can be purged with the air vacuum pump 38 as described above. In a simplified process, vacuum pump 38 and 64 are actually one pump such as a dry vacuum pump, which can handle both air and vapor.

Figure 5:
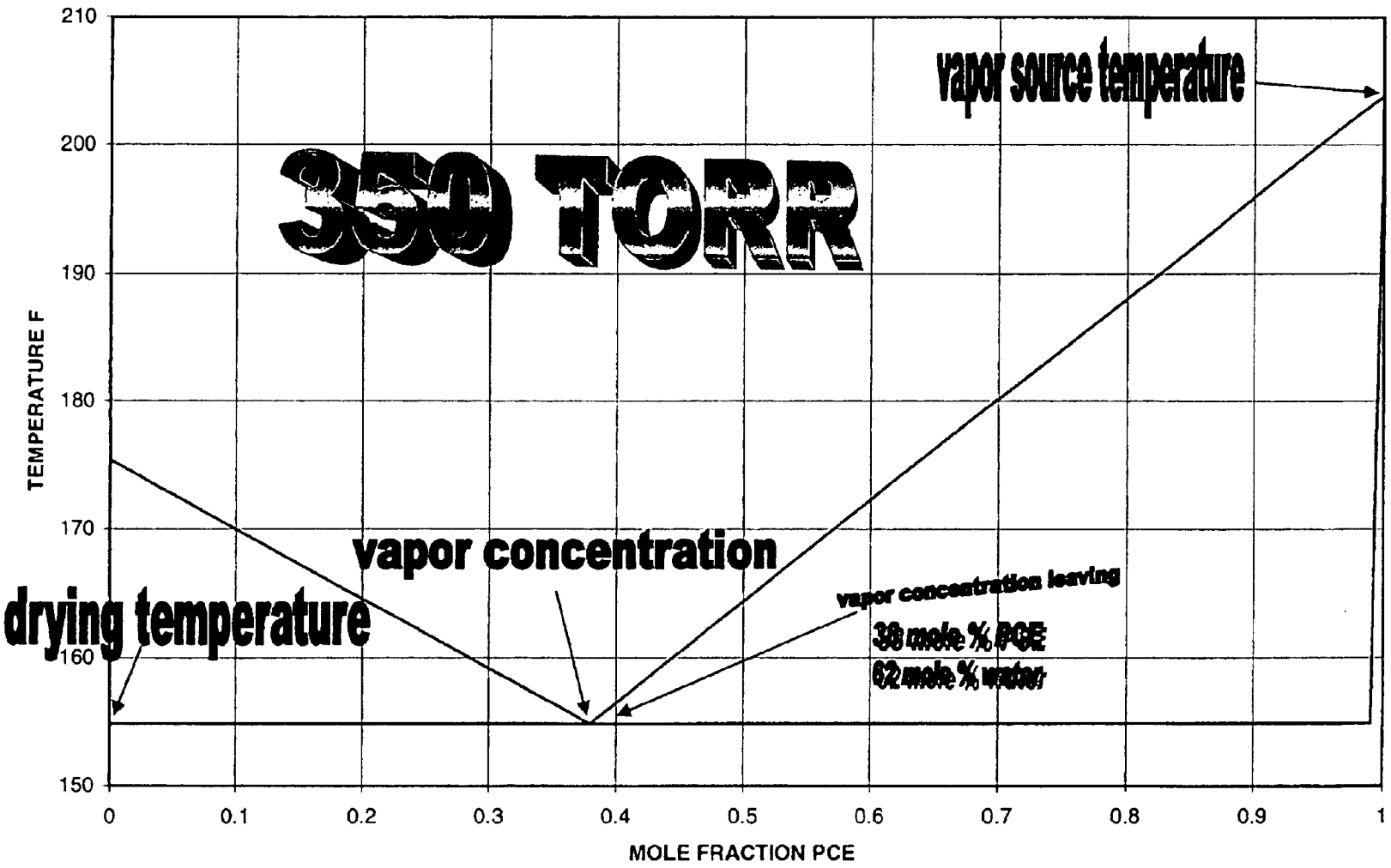
FIG. 5 is a chart detailing the relationship between the phases of water and PCE at varying temperatures in the alternate embodiment system.

FIG. 5 shows the points of interest for the vacuum drying process. The equilibrium conditions at 350 torr show that it can be expected that the entering vapor from the PCE heated solvent tank can be expected to enter the chamber at 204° F. Until there is essentially little water remaining on the part, the leaving vapor can be expected to be rich in water vapor and approach the equilibrium mixture of 62% water. The temperature of the drying is at 155° F. that would be equivalent to drying water from the part at 130 torr under a vacuum.

Sometimes it may desirable to keep the drying solvent entering chamber 12 from fluid supply tank 24 from condensing on the part 18. Closing throttling valve 50 to create a pressure difference between the fluid supply tank 24 and drying chamber 12 may prevent condensing. The solvent vapor as it passes through the valve 50 will not drop in temperature very much in an adiabatic process and the vapor entering into the chamber 12 is essentially superheated vapor. If the solvent-water vapor mixture is removed rapidly from the chamber by vacuum pump 46 and condenser 62, then the heat given up by the incoming vapor would only be the sensible heat of the vapor and solvent condensate would not precipitate on the part 18.

Figure 6:
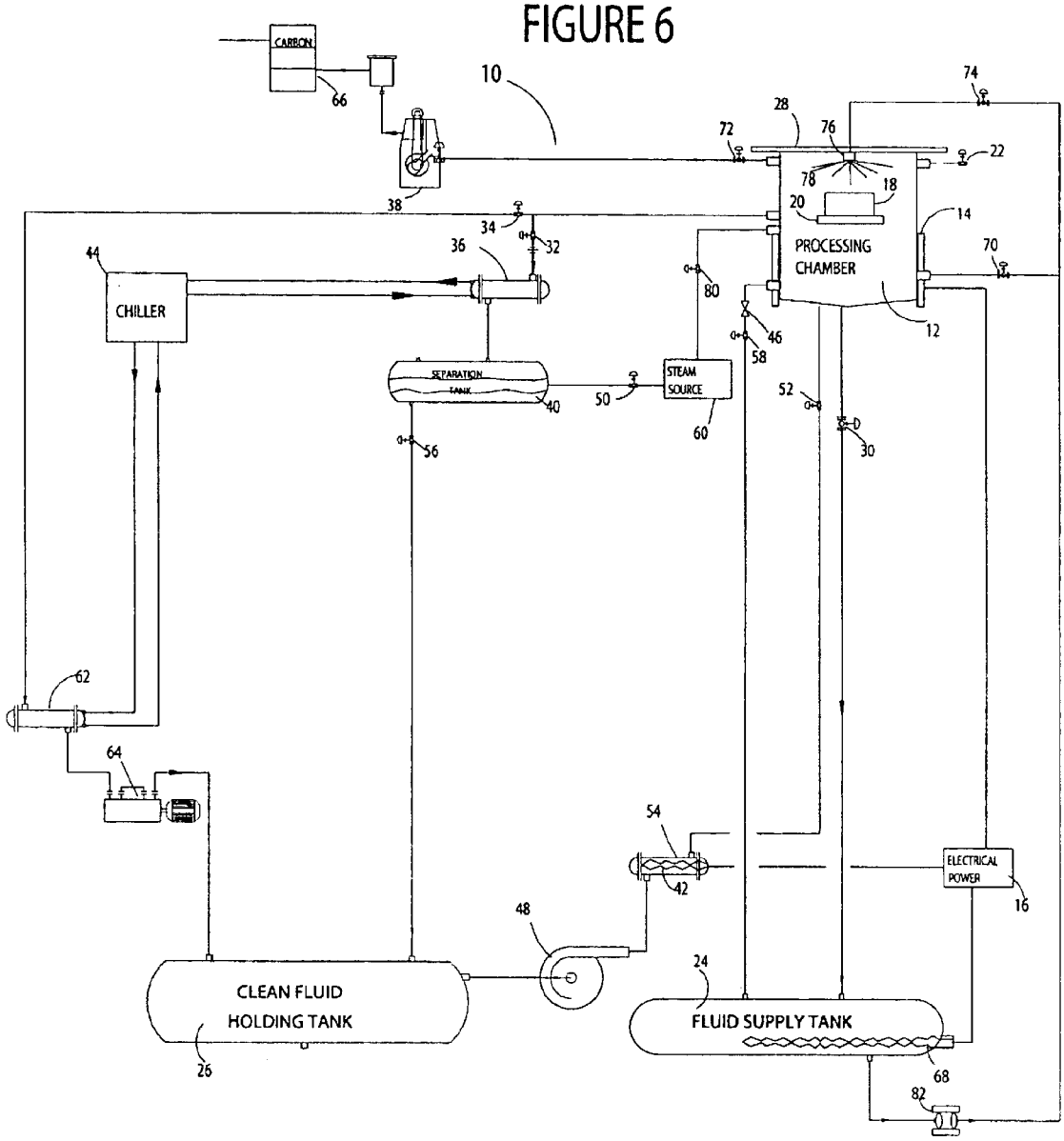
FIG. 6 is a schematic diagram of a second alternative embodiment of the system of the present invention.

It may be desired to bring the part 18 into contact with solvent liquid possibly for cleaning, surface treating, etching or other type of parts processing. The solvent from fluid supply tank 24 can be pumped into the chamber 12 as shown in FIG. 6. The heated solvent is sent to the chamber 12 by activating liquid pump 82 and opening either valve 70 to send in a solvent soak or valve 74 to spray liquid spay 78 through spray nozzle 76. Other means of sending liquid solvent to the chamber such as vacuum pulling, dumping or other conventional means can be used to transport solvent.

In the process above, the drying process can be very rapid. Rapid drying may be desirable in order to prevent water spotting to occur which is often encountered in slow drying processes such as air-drying. When the solvent enters the chamber 12, the equilibrium vapor state is rapidly changed by the rapid heating of the part and water and the immediate reduction in water vapor in the chamber 12. The liquid water immediately is put into an environment that promotes the boiling of the water. The liquid boils so rapidly that the liquid will cool at the vapor-liquid surface and the water at the solid-liquid surface boils off and the liquid water will explode from the surface. This rapid removal of water from the surface prevents the insoluble residue that forms water spots by migrating to the outer ring of a drop, which occurs in slow drying processes such as air-drying. The process above therefore can be used to prevent water spotting on parts.

During rapid drying as described above, small particles at the water-solid interface can be dislodged from the surface and removed from the chamber with the water-solvent vapor stream. This process can be very efficient in parts which have small holes, pores or crevices such as vias as encountered in wafers in the semiconductor industry. The channel acts as a rapid heat source since water is contacting the solid at the channel end which has a relatively high surface area to water volume ratio. The particles are shot from the channels by the rapidly evaporating and expanding water vapor.

Rapid drying is desirable to prevent water spotting or remove particles. For these results, higher boiling solvents, higher pressures, and superheated vapors is the system of choice. It may be desirable to slow the drying process down as when rapid drying may cause excessive shrinkage or possible damage to parts. In this case lower boiling solvents and lower pressures should be employed.

Often it becomes desirable to dry solvents from parts and recover the solvents for either environmental reasons or operating cost or waste disposal savings. Water in this case can act as the drying solvent and the water and solvent can be recycled as depicted in FIG. 6. In FIG. 6, after object 18 has been cleaned or treated with the solvent in fluid supply tank 24, steam can be injected in cleaning chamber 12 through valve 80 from steam source 60. The solvent vapor-steam mixture can be continuously removed from the chamber 12 by opening valve 32 and sending the mixture to condenser 36. The condensed liquid will separate in separation tank 40 and the water can be recycled to steam source 60 by opening valve 50. The solvent can be recycled for future use as a cleaner or surface treatment fluid for object 18 by opening valve 56. Examples of this type of process use would be the drying of PCE from garments in the dry cleaning industry or the drying of oil base paint in the paint stripping and finishing industries.

The above examples of the present invention have been described for purposes of illustration and are not intended to be exhaustive or limited to the steps described or solvents used in the descriptions. The scope of the invention is wide and can cover many industries and processes as illustrated in the sample examples stated. It will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A closed circuit solvent drying method comprising the steps of:

placing an object to be dried of water in a chamber;

sealing the chamber;

evacuating the air from said chamber to reduce the pressure within said chamber to create a vacuum condition;

introducing a fluid to the evacuated chamber from a fluid supply tank to heat the object contained therein and vaporize the water on the object;

continuously recovering the fluid and water vapor from the object and the chamber while continuously introducing additional fluid to the chamber;

ceasing the introduction of fluid to the chamber;

recovering the fluid from the object and chamber;

introducing a non-condensable gas to the chamber to return the chamber to atmospheric pressure;

opening the chamber and removing the object; and separating said drying fluid from the recovered water vapor and retaining said drying solvent for use in drying subsequent objects.

2. The solvent drying method in claim 1, wherein said step of reducing the pressure within said chamber comprises reducing the pressure to between atmospheric pressure and zero absolute pressure.

3. The solvent drying method in claim 1, wherein said step of continuously recovering the fluid and water vapor from the object and chamber comprises withdrawing the fluid and water vapor in a vapor state by reducing the pressure in the chamber using a device selected from the group consisting of: a vacuum pump, an ejector, a condenser, an aspirator and a cryogenic pump.

4. The solvent drying method in claim 1, wherein the step of introducing said drying fluid into said chamber is selected from the group consisting of: vapor, gas-vapor mixture, aerosol spray, liquid spray and liquid soak.

5. The solvent drying method in claim 1, wherein the step of introducing said drying fluid into said chamber includes throttling said fluid through a valve or other flow restricting device so as to control the pressure in said drying chamber.

6. The solvent drying method in claim 1, said step of recovering said drying fluid from said object and said chamber further comprising:

withdrawing a first portion of said fluid from said chamber in a liquid state; and withdrawing the remaining portion of said fluid from said chamber in a vapor state.

7. The solvent drying method in claim 6, said step of withdrawing said fluid in a vapor state further comprises:

reducing the pressure in said chamber causing said fluid to flash to form a vapor; and withdrawing said vapor from said chamber.

8. The solvent drying method of claim 1, wherein said water removed from the object and the fluid used for drying the object is separated in a water separator and stored in separate holding tanks for future use.

9. The solvent drying method of claim 1, wherein the fluid introduced to the chamber also serves as a rinsing fluid for the object and chamber.

10. The solvent drying method of claim 1, wherein the fluid introduced to the chamber for drying the object also treats the object using a method selected from the group consisting of: etching, abrasion, blasting, dissolving, debinding, penetrating, particle removal and impregnating.

11. The solvent drying method of claim 1, wherein the fluid introduced to the chamber is introduced rapidly thereby drying the object so rapidly that particles or non-volatile residue is mechanically lifted from the surface or pores of the object to prevent spotting and produce a particle free surface.

* * * * *